US005713684A

United States Patent [19]

Turecamo

[11] Patent Number: 5,713,684

[45] Date of Patent: Feb. 3, 1998

[54] GREETING CARD ALBUM

[76] Inventor: Nathalie W. Turecamo, 5872 Auvers Blvd. #307, Orlando, Fla. 32807

[21] Appl. No.: 847,893

[22] Filed: Apr. 28, 1997

Related U.S. Application Data

[63] Continuation of Ser. No. 440,348, May 12, 1995, abandoned.

[51] Int. Cl.[6] ..... B42F 13/00

[52] U.S. Cl. ..... 402/79; 281/38; 281/22; 281/31; 402/80 R

[58] Field of Search ..... 402/79, 80 R; 281/38, 51, 35, 22, 31; 283/117; 40/776, 771; D19/1, 26, 27; 428/14

[56] References Cited

U.S. PATENT DOCUMENTS

| | | | |
|---|---|---|---|
| D. 161,580 | 1/1951 | Garrison | D6/2 |
| D. 244,024 | 4/1977 | Audeguy | D19/27 |
| D. 311,208 | 10/1990 | Folson | D19/27 |
| D. 314,977 | 2/1991 | Wyant | D19/27 |
| D. 350,365 | 9/1994 | Kelley et al. | D19/27 |
| 4,447,973 | 5/1984 | Wiihlke | 40/776 |
| 4,771,557 | 9/1988 | Bowman | 40/661 X |
| 4,852,280 | 8/1989 | Beattie | 40/124 |
| 4,965,948 | 10/1990 | Ruebens | 40/776 X |
| 5,127,756 | 7/1992 | Lumm | 402/79 |
| 5,242,062 | 9/1993 | Engravalle | 211/45 |
| 5,323,553 | 6/1994 | Candido | 40/661 X |
| 5,335,796 | 8/1994 | Sanford et al. | 211/45 |
| 5,431,449 | 7/1995 | Arimoto et al. | 281/38 X |

FOREIGN PATENT DOCUMENTS

| | | | |
|---|---|---|---|
| 29275 | of 1896 | United Kingdom | 283/56 |
| 537845 | 7/1941 | United Kingdom | 402/79 |

*Primary Examiner*—Frances Han
*Attorney, Agent, or Firm*—White & Case

[57] ABSTRACT

A greeting card album (1) with a plurality of pages (6) for holding, displaying and preserving greeting cards (9). Each page contains a pocket sleeve (7) formed by overlays (20,29) sealed at a top edge (36), bottom edge (37) and outer edge (19) with an opening along an inner edge (25) into which the back leaf of the greeting card (5) can be inserted in a manner so that it can be opened and read without having to remove the card from the album page. Each album page is preferably made of transparent plastic with the pockets formed by heat sealing the edges thereof. The pages can be secured in the album by various means, preferably rings (14,28) through holes (16,31) in the inner portion of pages, such that pages may be added or subtracted as needed or desired. The album may be divided or cataloged into sections as desired by attaching tabs (10,11,12) to the outer edges of pages and marked according to the occasion, such as birthdays, anniversaries and holidays.

13 Claims, 2 Drawing Sheets

GREETING CARD ALBUM

This application is a continuation of application Ser. No. 08/440,348, filed May 12, 1995 now abandoned.

BACKGROUND OF THE INVENTION

This invention relates generally to an apparatus and method of holding and displaying greeting cards, and more particularly an album that allows cards to be preserved and displayed without having to remove them from the album.

Unfortunately, when people receive greeting cards which they want to save, they end up putting them in a drawer or some place else. If they want to view the cards again they must retrieve them, that is, if they can even find them. Also, such storage and repeated handling of the cards damages the cards. Furthermore, for special occasions such as birthdays, anniversaries and the holidays, many people want to preserve and catalog their greeting cards together so they can be viewed as desired, much like photographs in a photo album.

Thus, a need exists for a greeting card album that will enable people to store, display, preserve and catalog their greeting cards.

The relevant prior patented art to that includes the following patents:

| U.S. Pat. No. : (U.S. unless stated otherwise) | Inventor: | Date of Patent: |
|---|---|---|
| DES 311,208 | Folson | Oct. 9, 1990 |
| DES 161,580 | Garrison | Jan. 9, 1951 |
| DES 244,024 | Audeguy | Apr. 12, 1977 |
| DES 314,977 | Wyant | Feb. 26, 1991 |
| DES 350,365 | Kelley, et al. | Sep. 6, 1994 |
| 5,335,796 | Sanford, et al. | Aug. 9, 1994 |
| 5,242,062 | Engravalle | Sep. 7, 1993 |
| 4,852,280 | Beattie | Aug. 1, 1989 |

The Folson patent covers one design of a greeting card album having pairs of connecting transparent sleeve-like pages which hold the greeting card in an open position. However, the cards cannot be easily removed if one wants to view the entire card. The Garrison patent covers one design for a greeting card booklet that has been indexed. The Audeguy patent discloses an album with transparent pages and pockets that could be used to hold greeting cards, but has a different structure than the present invention. The Wyant patent shows a folder with pockets. The Kelley patent is another design patent that teaches a binder with transparent display pockets on the front for displaying photographs. The Sanford patent teaches an upright greeting card holder wherein the cards are mounted on rods around a central spindle which can be rotated to view the cards. The Engravalle patent teaches a plaque-like device with diagonal slots for holding greeting cards for particular occasions. Finally, the Beattie patent discloses a cylindrical display device for greeting cards which uses vertical strands through which the cards are mounted.

Although there are many greeting card display devices in the prior art, none has the same structure as does the present greeting card album.

Contrary to the patents in the prior art, the present invention is a greeting card album and a page therefor which contains at least one overlay into which the back leaf of a greeting card can be placed, allowing the remainder of the card to be opened so that it may be read and displayed without having to remove it from the page.

SUMMARY OF THE INVENTION

The primary object of the present invention is to provide an apparatus for storing and preserving greeting cards.

Another object of the present invention is to provide an apparatus for displaying greeting cards.

A related object of the present invention is to provide an apparatus for displaying greeting cards without having to remove the cards from the apparatus.

Another object of the present invention is to provide such an apparatus that will allow the cards to be easily removed and replaced as desired.

An even further object of the present invention is to provide an apparatus which will allow the greeting cards to be cataloged according to special occasions or as desired.

The present invention fulfills the above and other objects by providing a greeting card album that has front and back covers connected by a binder, having means for retaining a plurality of pages between said covers, each page having at least one overlay attached to the page to form a pocket sleeve designed to retain a back leaf of a greeting card in a manner such that the greeting card can be opened and read without having to remove said card from the page. Each page may be secured between the front and back covers of said album by various means, including a plurality of rings secured through holes in the inner edge of each page, such that pages may be added or subtracted as needed or desired. Although the pages could be made of any material, the pages would be preferably transparent so the entire greeting card could be read without removing it from the pocket in each page. The page would be preferably made of transparent plastic with each section separated by a heat seal and the overlays formed by heat sealing the top, bottom and outer edges, leaving the inner edge of the overlay open to insert the greeting card. Sections of the greeting card album may be divided by special occasion, such as by tabs attached to the outer edges of the pages dividing each section.

The above and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENTS

Figure 1:
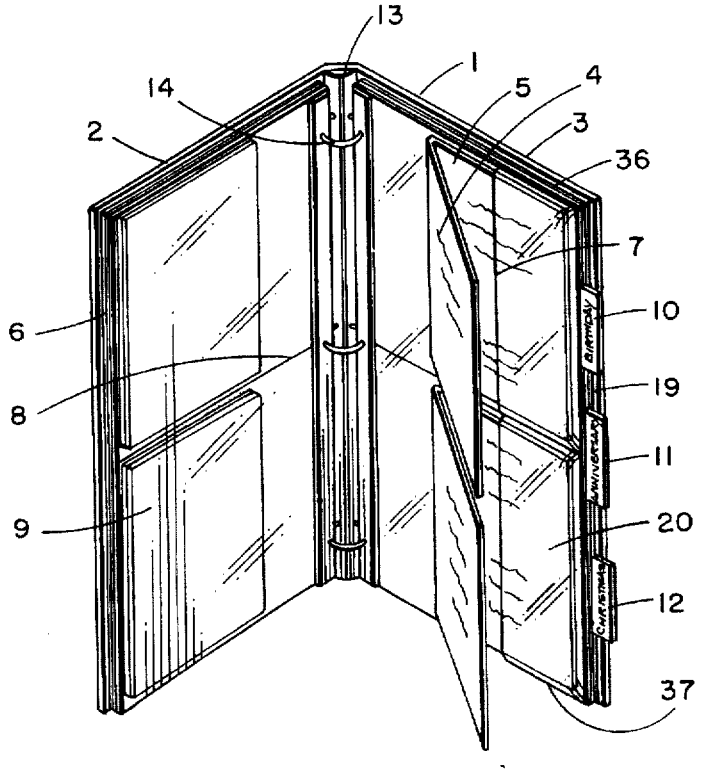
FIG. 1 is a perspective view of a greeting card album with the greeting cards in a display position and cataloged by attached tabs.

Referring now to the drawings, in FIG. 1 the greeting card album generally shown as 1 is shown containing a front cover 2, back cover 3, connected by a binder section 13 to which may be attached means for retaining pages comprising of said means consisting of plurality of rings 14, such that pages may be added or subtracted as needed or desired. As shown, the album pages 6 contain sleeve pockets which are made by overlays 29 attached to each album page 6 at a top edge 36, bottom edge 37 and outer edge 19 and openable at the inner edge 25 to form a sleeve pocket 7 for holding the back leaf of a greeting card 5. Only the back leaf 5 of the greeting card is inserted in the pocket 7 so that the remainder of the greeting card such as the front 4 may be read and then opened to read the inscription or writing on the inside of the greeting card. Each page of the greeting card album would preferably be made of transparent plastic to facilitate displaying and reading the card without having to remove the greeting card. Furthermore, using plastic allows the pockets to hold the greeting cards to be easily formed by heat sealing. On those album pages 6 where greeting cards were not currently being displayed, the cards 9 would appear in a closed position. Each album page could be made to hold a plurality of greeting cards merely by dividing each page into sections along sealed sections such as 8.

Figure 2:
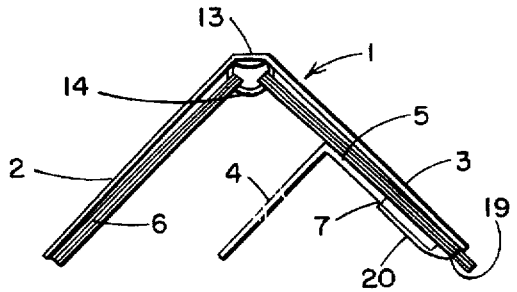
FIG. 2 is a top view of a greeting card album showing a greeting card in a display position.
Figure 8:
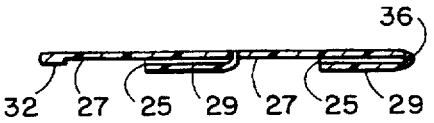
FIG. 8 is a top cross-section view of the four-card album page of FIG. 7. along lines 6—6 of FIG. 7.

In FIG. 2, the greeting card album of FIG. 8 is shown from a top view which shows the greeting card in an open or display position. This view also really shows the overlay section 20 of the page of each open page which is sealed at the outer edge 19 and open at the inner edge 7 to form a pocket into which the back of each greeting card 5 may be inserted.

Figure 3:
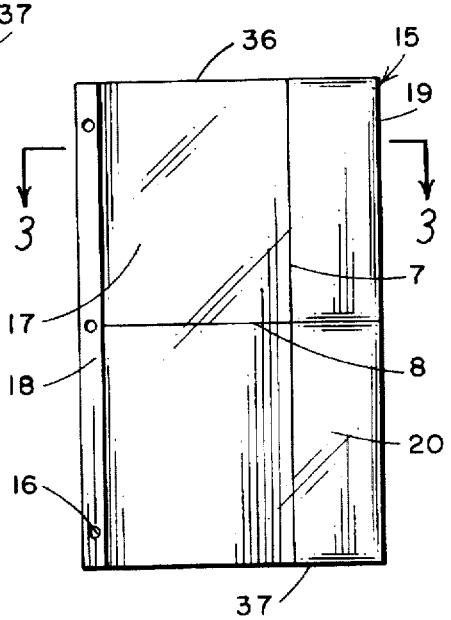
FIG. 3 is a from view of a two-card page for an album.
Figure 4:
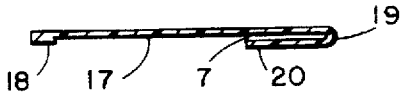
FIG. 4 is an enlarged top cross-section view of the album page of FIG. 3 along lines 3—3.

In FIGS. 3 and 4, the two-card holding album page 15 is shown by itself. Each page would contain a reinforcing section 18 near its inner edge which may contain a plurality of holes 16 through which rings 14 attached to the binder 13 of the album could be inserted to secure a plurality of pages therein and allow for addition or subtraction of pages as needed or desired. Other means for securing pages, although not shown in the drawings may include a spiral binder or glue binding. A two-card page would contain two overlays 20 formed by a seal at the top edge of the page 36 and the bottom edge of the page 37 and also along the dividing line 8 between each section. Sealing the overlay 20 in that manner would leave the inner edge 7 open to form a sleeve pocket so that the back leaf of each greeting card could be inserted therein leaving the remainder open for reading and display. The remainder of the album page would preferably be a single layer of material 17.

Figure 5:
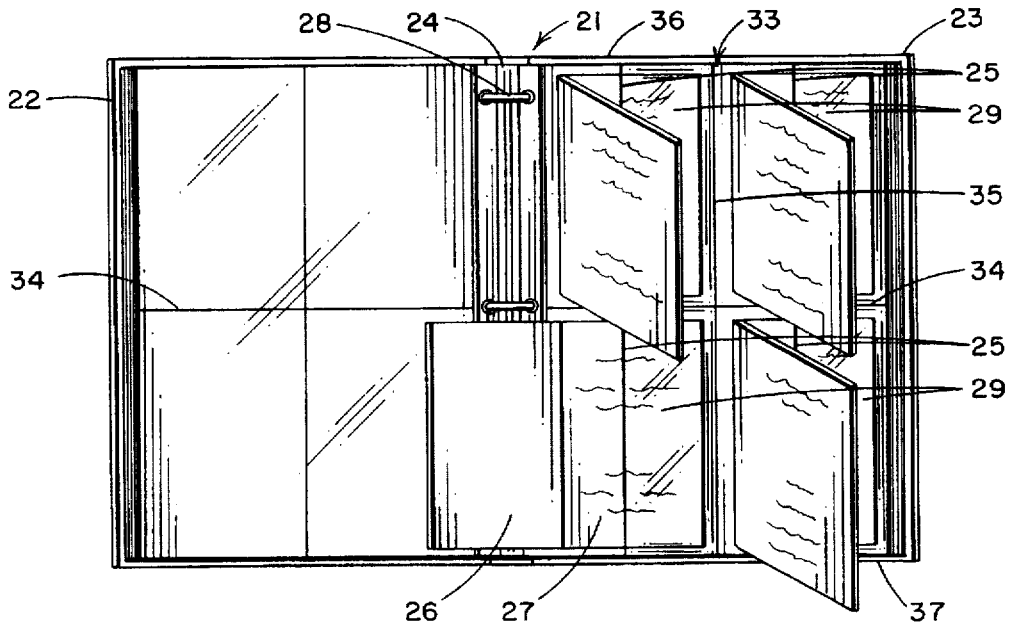
FIG. 5 is a front view of a greeting card album able to hold four cards per page showing the cards in a display position.
Figure 6:
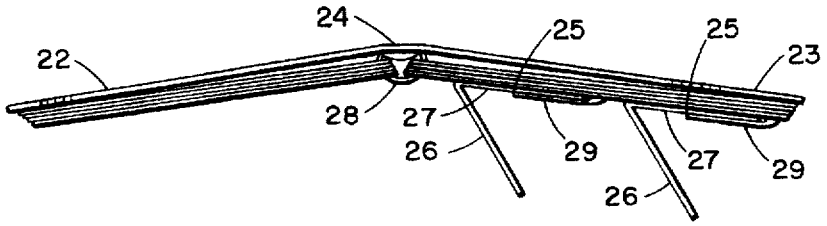
FIG. 6 is a top view of the greeting card album of FIG. 5.

FIGS. 5 and 6 illustrate the greeting card album 21 containing four-card holding pages 33. These pages would contain at least four overlays sealed at the top edge 36 and bottom edge 37 of the page, along the horizontal dividing sections so as to form an open pocket 25 into which the back leaf 27 of each card could be inserted so that the front leaf 26 could be opened for display and reading. Similarly, the four-card album pages would be held between the front cover 22 and back cover 23 of the greeting card album by rings 28 attached to the album binder 24 and passing through holes in the inner edges of each album page.

Figure 7:
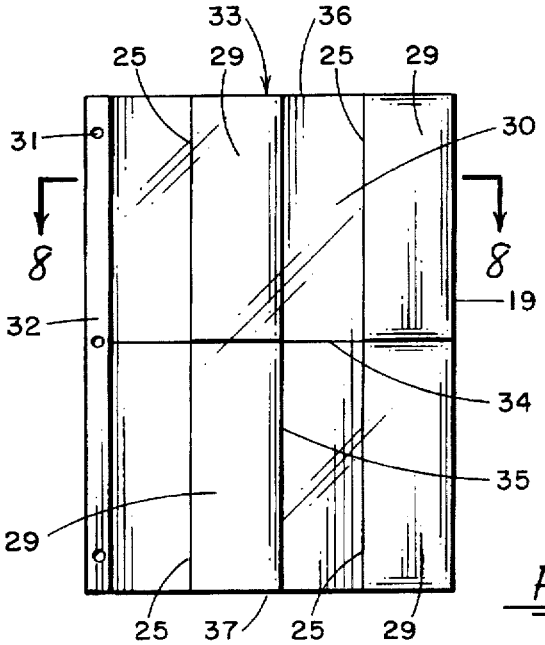
FIG. 7 is a front view of an album page designed to hold four greeting cards.

FIGS. 7 and 8 illustrate an embodiment of the album page 33 designed to hold four cards. The four-card album page 33 is divided into four sections along intersecting horizontal and vertical lines 34 and 35, respectively. The four pockets are formed by overlays 29 which are sealed at the top 36 and bottom 37 edges of the pages, along the vertical dividing lines 35, along outer edge 19 of the page and along the horizontal dividing line 34, thereby leaving an open pocket 25 into which the back leaf of a greeting card can be inserted. Each page may contain a reinforcing inner portion 32 with a plurality of holes 31 or other means which could be secured within the greeting card album to allow for addition or subtraction of pages as needed or desired.

Although the drawing figures used to illustrate a few preferred embodiments show pages which are divided into sections to hold multiple cards, as all greeting cards are not a standard size, the pages may be designed to hold only one card each within a transparent pocket running the length of the page.

As described above, the present invention provides a greeting card album which offers numerous advantages over the prior art. Among the advantages are that it allows one to store and preserve greeting cards, to display and view greeting cards without having to remove them from the album pages, and also to catalog the greeting cards by occasion or as desired.

Although only certain embodiments of the present invention have been described in detail hereinabove, all improvements and modifications of this invention within the scope or equivalents of the claims are covered by this invention.

Having thus described my invention, I claim:

1. A greeting card album for holding, displaying and preserving greeting cards comprising:

a front cover and back cover connected by a binder portion having means for retaining a plurality of pages between said front and back covers;

a plurality of pages retained in the binder, each page having an upper edge, a lower edge, and a width defined by the distance between left and right edges of the page;

at least one rectangular transparent strip disposed over each page, said strip having (i) a top edge sealed to the upper edge of the page; (ii) a bottom edge sealed to the lower edge of the page; (iii) an inner edge not sealed to the page; and (iv) an outer edge sealed to the page; said strip having a width defined by the distance between the inner and outer edges, and the width of the strip is less than the width of the page; and a horizontal dividing line traversing across the entire width of the strip and sealed to the page;

wherein the top edge, outer edge and horizontal dividing line define an upper vertically-oriented sleeve pocket that is open at the inner edge of the strip;

wherein the horizontal dividing line, outer edge and bottom edge define a lower vertically-oriented sleeve pocket that is open at the inner edge of the strip; and wherein each pocket can hold a back leaf of the greeting card in a manner such that the greeting card can be opened and read without having to remove said greeting card from the page.

2. The greeting card album of claim 1 wherein each page has two strips to form four open sleeve pockets for holding the back leaf of four greeting cards.

3. The greeting card album of claim 2 wherein outer edges of selected pages contain tabs for marking, cataloging and dividing sections of the album of greeting cards according to desired occasions.

4. The greeting card album of claim 2 wherein each page is transparent.

5. The greeting card album of claim 4 wherein outer edges of selected pages contain tabs for marking, cataloging and dividing sections of the album of greeting cards according to desired occasions.

6. The greeting card album of claim 1 wherein each page is transparent.

7. The greeting card album of claim 6 wherein outer edges of selected pages contain tabs for marking, cataloging and dividing sections of the album of greeting cards according to desired occasions.

8. The greeting card album of claim 1 wherein outer edges of selected pages contain tabs for marking, cataloging and dividing sections of the album of greeting cards according to desired occasions.

9. The greeting card album of claim 1 wherein the means for retaining a plurality of pages in the greeting card album consists of a plurality of rings attached to the binder portion and passing through holes near the inner edges of the greeting card album pages, so that pages can be added to or removed from the album as needed or desired.

10. A page for a greeting card album comprising:

a planar layer of material having an upper edge, a lower edge, and a width defined by the distance between left and right edges;

at least one rectangular transparent strip disposed over the material, said strip having (i) a top edge sealed to the upper edge of the material; (ii) a bottom edge sealed to the lower edge of the material; (iii) an inner edge not sealed to the material; and (iv) an outer edge sealed to the material; said strip having a width defined by the distance between the inner and outer edges of the strip, and the width of the strip is less than the width of the material; and a horizontal dividing line traversing across the entire width of the strip and sealed to the material;

wherein the top edge, outer edge and horizontal dividing line define an upper vertically-oriented sleeve pocket that is open at the inner edge of the strip;

wherein the horizontal dividing line, outer edge and bottom edge define a lower vertically-oriented sleeve pocket that is open at the inner edge of the strip; and wherein each pocket can hold a back leaf of the greeting card in a manner such that the greeting card can be opened and read without having to remove said greeting card from the page.

11. The page of claim 10 wherein each page has two strips to form four open pockets into which the back leaf of a four greeting cards can be inserted.

12. The greeting card album of claim 10 wherein each page is made of transparent plastic.

13. The greeting card album of claim 11 wherein each page is made of transparent plastic.

* * * * *